US005728501A

United States Patent [19]

Nakanishi et al.

[11] Patent Number: 5,728,501

[45] Date of Patent: Mar. 17, 1998

[54] CHARGE CONTROLLER, TONER BINDER COMPOSITION AND ELECTROPHOTOGRAPHIC TONER

[75] Inventors: Hideo Nakanishi; Tohru Ohama; Naoki Takase; Akira Kodani; Munekazu Satake, all of Kyoto, Japan

[73] Assignee: Sanyo Chemical Industries, Ltd., Kyoto, Japan

[21] Appl. No.: 621,065

[22] Filed: Mar. 22, 1996

[30] Foreign Application Priority Data

| | | | |
|---|---|---|---|
| Oct. 17, 1995 | [JP] | Japan | 7-294779 |
| Oct. 27, 1995 | [JP] | Japan | 7-303527 |
| Nov. 27, 1995 | [JP] | Japan | 7-332790 |

[51] Int. Cl.[6] ..... G03G 9/097

[52] U.S. Cl. ..... 430/110

[58] Field of Search ..... 430/109, 110, 430/904

[56] References Cited

U.S. PATENT DOCUMENTS

| | | | |
|---|---|---|---|
| 4,686,166 | 8/1987 | Kumagai et al. | 430/110 |
| 5,147,750 | 9/1992 | Nakanishi et al. . | |
| 5,571,651 | 11/1996 | Inaba et al. | 430/110 |

*Primary Examiner*—John Goodrow

*Attorney, Agent, or Firm*—Oblon, Spivak, McClelland, Maier & Neustadt, P.C.

[57] ABSTRACT

A charge controller for a toner, containing a polymer of an ethylenically unsaturated monomer, where the polymer has a dielectric loss tangent (tan δ) at 100 kHz of 0.008 to 0.3 and a water absorbency of at most 10% by weight, and selected from the group consisting of:

(1) a polymer (A1) having units resulting from a monomer (1) having an aromatic ring substituted with at least one electron-attracting group (X) selected from the group consisting of halogen, a nitro group and a cyano group; and (2) a copolymer (A2) of a monomer (2) having an organic acid group or salt thereof, with one or more copolymerizable monomers, a toner binder and toner containing the same are provided which give excellent properties with respect to electrostatic charge amount, charging rate and environmental stability, as well as providing an essentially colorless charge controller containing no metal and improved dispersing properties and transparency.

22 Claims, No Drawings

CHARGE CONTROLLER, TONER BINDER COMPOSITION AND ELECTROPHOTOGRAPHIC TONER

BACKGROUND OF THE INVENTION

1. Field of the Invention

The present invention relates to a charge controller agent, a toner binder composition and a toner for electrostatic latent imaging.

2. Description of the Prior Art

Previously, the addition of a charge controller has been used for the purpose of controlling the electrostatic charge of an electrophotographic toner. Charge controllers can be negatively chargeable (hereinafter referred to as "negative charge controllers") or positively chargeable ("positive charge controllers"). Conventional negative charge controllers include compounds such as azo dye stuff compounds, salicylic acid-metal complexes and the like.

As improved negative charge controller compounds, polymers have been proposed as follows:

(1) A copolymer of styrene and the sodium salt of vinyl benzenesulfonic acid (Japanese Patent KOKAI No. 88564/1985), 2) A combination of a polymer of perfluoroalkylethyl acrylate and a copolymer of styrene, methyl acrylate and 2-acrylamide-2-methylpropanesulfonic acid (Japanese Patent KOKAI No.230609/1994), (3) A block copolymer of methyl methacrylate and methacrylic acid (U.S. Pat. No. 4,925,765).

However, when using the polymer compounds disclosed in (1)–(3), the electrostatic charge of the toner is poor. Thus, a lot of charge controller is required and it is not economical. Their use additionally impairs other properties required in a toner, such as low temperature fixing properties and anti-hot offset properties. The charging rate (stirring period using a frictional force when the charge reaches a required charge amount) is also inadequate. Therefore, a copying machine using these charge controllers requires a longer warm-up time and the copied image becomes bad during continuous copying. The change of charge due to humidity is large and environmental stability is inadequate.

Furthermore, the transparency is poor when the toner is formulated, resulting in detrimental effects in the color tone in applying color toner.

SUMMARY OF THE PRESENT INVENTION

Accordingly, it is one object of the present invention to provide an essentially colorless charge controller containing no metal.

Another object of the present invention is to provide a charge controller having excellent properties with respect to the electrostatic charge amount, the charging rate and the environmental stability of toner.

Another object of the present invention is to provide a charge controller which overcomes the above-mentioned difficulties with respect to dispersing properties and transparency.

These and other objects of the present invention have been satisfied by the discovery of a charge controller for a toner which comprises a polymer of an ethylenically unsaturated monomer, said polymer having a dielectric loss tangent [tan δ] at 100 kHz of 0.008 to 0.3 and a water absorbency of at most 10% by weight, wherein the polymer is a member selected from the group consisting of:

(1) a polymer (A1) of a monomer (1) having an aromatic ring substituted with at least one electron-attracting group (X) selected from the group consisting of halogen, a nitro group and a cyano group; and (2) a copolymer (A2) of a monomer (2) having an organic acid group or salt thereof, with a further copolymerizable monomer, a toner binder composition which comprises said charge controller and a toner binder resin, and a toner which comprises a toner binder resin, a colorant and said charge controller.

DETAILED DESCRIPTION OF THE PREFERRED EMBODIMENTS

According to the present invention, the dielectric loss tangent [tan δ] at 100 kHz is measured as follows:

A polymer is pulverized with an agate mortar into a powder having an average diameter of not more than 50 μm, and a test piece is prepared by compression molding, in an electrode for dielectric loss tangent measurement. The test piece is tested with the electrode for both conductance and capacitance at 100 kHz, followed by measuring its thickness. The dielectric loss tangent is calculated from the conductance, capacitance and thickness thus measured.

A suitable value of dielectric loss tangent is generally in the range of 0.008–0.3, preferably 0.008–0.2, more preferably 0.015–0.1. Polymers having a dielectric loss tangent of less than 0.008 may have an insufficient charging rate, while polymers having a dielectric loss tangent of more than 0.3 may result in a shortage of the electrostatic charge amount of the toner.

According to the present invention, water absorbency (%) is measured as following:

In the same manner as mentioned above, a polymer is pulverized with an agate mortar into a powder having an average diameter of not more than 50 μm. 2 g of the powder are dried under reduced pressure at 35° C. for 4 hours then weighed. The weighed powder is then treated in a controlled atmosphere at 85% R.H. (relative humidity) at 35° C. for 12 hours. Thereafter the weight is measured again and the water absorbency (%) is calculated from the percentage increase of weight (the difference between the weight of after drying and that of before drying) relative to the weight before drying.

Water absorbency (%) is generally in the range of at most 10% by weight, preferably at most 5% by weight, more preferably at most 2% by weight. Polymers having more than 10% by weight of water absorbency may result in poor environmental stability.

Suitable polymers for use in the present invention include polymer (A) of one or more ethylenically unsaturated monomers.

Suitable polymers (A) include:

(1) polymers (A1) of a monomer (1) having an aromatic ring substituted with at least one electron-attracting group (X) selected from the group consisting of halogen, a nitro group and a cyano group; and (2) copolymers (A2) of a monomer (2) having an organic acid group or salt thereof, with one or more other copolymerizable monomers.

Suitable electron-attracting groups (X) include, for example, halogen atoms (such as chlorine, bromine, iodine and fluorine), a nitro group and a cyano group. Among these, chlorine and a nitro group are preferable.

Suitable examples of monomer (1) having an aromatic ring substituted with at least one electron-attracting group (X) include: styrenes (such as chlorostyrene, dichlorostyrene, bromostyrene, fluorostyrene, nitrostyrene, cyanostyrene); aromatic ring-containing maleimides (such as chlorophenylmaleimide, dichlorophenylmaleimide, nitrophenylmaleimide, nitrochlorophenylmaleimide); aromatic ring-containing itaconimides (such as chlorophenylitaconimide, dichlorophenylitaconimide, nitrophenylitaconimide, nitrochlorophenylitaconimide); aromatic ring-containing (meth)acrylates (wherein the term "(meth)acryl" as used herein represents acryl and methacryl-based compounds) (such as chlorophenyl (meth)acrylates, bromophenyl (meth)acrylates, nitrophenyl (meth)acrylates, chlorophenyloxyethyl (meth)acrylates, bromophenyloxyethyl (meth)acrylates, nitrophenyloxyethyl (meth) acrylates); aromatic ring-containing (meth)acrylamides (such as chlorophenyl(meth)acrylamides, bromophenyl (meth)acrylamides, nitrophenyl(meth)acrylamides); and aromatic ring-containing vinyl ethers (such as chlorophenyl vinyl ether, nitrophenyl vinyl ether). Among these, aromatic ring-containing maleimides and aromatic ring-containing itaconimides are preferred.

Polymers (A1) include both homopolymers or copolymers of at least one said monomer (1), and copolymers of monomer (1) with one or more other copolymerizable monomers.

Suitable examples of copolymerizable monomers include monomers (2) having an organic acid group or salt thereof, perfluoroalkyl group-containing monomers (3-1), silicone group-containing monomers (3-2) and other copolymerizable monomers (4), as well as combinations of two or more of these monomers.

Copolymers of monomer (1) with monomer (2) are preferable because the charging rate of the toner produced is fast.

Copolymers of monomer (1) with monomer (3-1) or monomer (3-2) are preferable because they improve the charge amount, charging rate and environmental stability of the toner produced.

Suitable examples of monomer (2) include sulfonic acid group-containing monomers (2-1), carboxylic acid group-containing monomers (2-2), sulfamic acid group-containing monomers (2-3), acid sulfate group-containing monomers (2-4), acid phosphate group-containing monomers (2-5) and salts thereof.

Suitable examples of monomer (2-1) include aromatic sulfonic acid group-containing monomers (such as styrenesulfonic acid, sulfophenylacrylamide, sulfophenylmaleimide, sulfophenylitaconimide) and aliphatic sulfonic acid group-containing monomers (such as vinylsulfonic acid, allylsulfonic acid, 2-acrylamide-2-methylpropanesulfonic acid, methacryloyloxyethylsulfonic acid).

Suitable examples of monomer (2-2) include (meth) acrylic acids, maleic acid, itaconic acid, monobutyl maleate, monoperfluoroalkylethyl maleate and monoperfluoroalkylethyl itaconate.

Suitable examples of monomer (2-3) include allylsulfonic acid, styrylsulfonic acid and vinylsulfonic acid.

Suitable examples of monomer (2-4) include sulfuric monoesters of hydroxy group-containing monomers (such as hydroxyethyl (meth)acrylates, hydroxyethyl vinyl ether and vinyl phenol).

Suitable examples of monomer (2-5) include phosphoric monoesters or diesters of the above-mentioned hydroxy group-containing monomers.

Suitable examples of salts of monomer (2) include those of alkali metals (such as lithium, sodium or potassium), alkaline earth metals (such as magnesium, calcium or barium), amines (such as triethylamine, tributylamine or N,N-dimethylbenzylamine), and quaternary ammoniums (such as tributylbenzylammonium, tetraethylammonium, or tetrabutylammonium).

Among these, monomers having a salt of an organic acid group are preferred to monomers having an organic acid group. More preferred are monomers having a salt of an alkali metal, an alkaline earth metal or amine. With regard to the kind of acid group, preferred monomers include monomers (2-1),(2-2) and (2-4), more preferably monomer (2-1). Most preferred are alkali metal, alkaline earth metal or amine salts of aromatic sulfonic acid group-containing monomers.

A salt of a heavy metal (such as nickel, copper, zinc, mercury or chromium) is undesirable because of safety.

Suitable examples of perfluoroalkyl group-containing monomers (3-1) include perfluoroalkylethylenes, perfluoroalkylethyl (meth)acrylates, mono(perfluoroalkylethyl) maleates, and mono(perfluoroalkylethyl) itaconates.

Suitable examples of silicone group-containing monomers (3-2) include esters of (meth)acrylic or maleic acids with terminal hydroxyl group-modified silicone oil; amides and imides of (meth)acrylic or maleic acids with terminal amino group modified silicone oil.

Among these monomers (3), perfluoroalkyl group-containing monomers are preferred. Those monomers having a $C_8$–$C_{16}$ perfluoroalkyl group are more preferred.

Suitable examples of other copolymerizable monomers (4), (other than monomer (3)) include olefins (such as ethylene, propylene, 1-butene, isobutylene or dodecene); vinyl ethers (such as methyl vinyl ether,butyl vinyl other or stearyl vinyl ether); aromatic vinyl hydrocarbons (such as styrene, α-methylstyrene, P-cumylstyrene); (meth)acrylic acids; alkyl (meth)acrylates (such as methyl (meth)acrylates, ethyl (meth)acrylates or butyl (meth)acrylates); dienes (such as butadiene or isoprene); vinyl esters (such as vinylacetate, or vinyl propionate); and monomers having a nitrile group (such as (meth)acrylonitriles).

Polymer (A1) generally contains units resulting from monomer (1) in an amount of at least 5% by weight, preferably at least 10% by weight, more preferably 20–89% by weight, in view of providing a sufficient amount of toner charge.

Polymer (A1) generally contains units resulting from monomer (2) in an amount of 0–20% by weight, preferably 0.1–20% by weight, more preferably 1–10% by weight.

Polymer (A1) generally contains units resulting from monomer (3) in an amount of 0–95% by weight, preferably 10–90% by weight, more preferably 10–79% by weight.

Polymer (A1) generally contains units resulting from monomer (4) in an amount of 0–95% by weight, preferably 0–50% by weight, more preferably 0–30% by weight.

Copolymers (A2) include copolymers of monomers (2) with one or more other copolymerizable monomers.

Suitable examples of copolymerizable monomers with monomer (2) include the above-mentioned monomers (3-1), monomers (3-2), and monomers (4).

Preferred examples and more preferred examples of comonomers for use in copolymers (A2) are the same as mentioned above with respect to polymers (A1).

Copolymers of monomer (2) with monomer (3) are preferred because they improve toner properties such as the charge amount, charging rate and environmental stability of toner.

Polymer (A2) generally contains units resulting from monomer (2) in an amount of at least 0.1% by weight, preferably 0.1–20% by weight, more preferably 1–10% by weight.

In the event of less than 0.1% content of monomer (2) by weight, the dielectric loss tangent becomes smaller and the charging rate of the toner may be inadequate. In the case of an amount larger than 20% by weight, the dielectric loss tangent becomes larger and the charge amount and environmental stability of the toner may be inadequate.

According to the present invention, polymer (A) has a weight-average molecular weight, Mw, of generally 1,000 to 500,000, preferably 2,000 to 200,000. If Mw is less than 1,000, it becomes compatible with the binder and the charge amount is insufficient. Further, if Mw is more than 500,000, it becomes difficult to disperse polymer (A) in the toner.

In a preferred embodiment of the invention, a copolymer (AB) is used in addition to the above-mentioned polymer (A), wherein copolymer (AB) comprises a polymer moiety (a) of polymer (A) selected from the group consisting of polymers (A1) of at least one monomer containing an aromatic ring substituted with at least one electron-attracting group (X) selected from the group consisting of halogen, a nitro group and a cyano group;

and copolymer (A2) of a monomer containing an organic acid group or salt thereof;

and a polymer moiety (b) of at least one polymer (B) selected from the group consisting of styrenic polymers (B1) and polyesters (B2);

the moiety (b) being bound graft-wise or block-wise to the moiety (a).

It is preferred that the particles of the discontinuous domains formed with moiety (a) in the toner can be easily formed in a small size.

Suitable styrenic polymers (B1) include either styrene homopolymers or copolymers of styrene with a copolymerizable monomer (6).

Suitable examples of the copolymerizable monomer (6) include aromatic vinyl hydrocarbons other than styrene, (meth)acrylic monomers and other vinyl monomers.

Suitable examples of aromatic vinyl hydrocarbons, other than styrene, include alkyl substituted styrenes (such as α-methylstyrene, p-methylstyrene, p-cumylstyrene); halogenated styrenes (such as chlorostyrene, and chloromethylstyrene) acetoxystyrene, and hydroxystyrene.

Suitable examples of (meth)acrylic monomers include alkyl substituted (meth)acrylates (such as methyl (meth) acrylates, ethyl (meth)acrylates, butyl (meth)acrylates, 2-ethylhexyl (meth)acrylates, lauryl (meth)acrylates, or stearyl (meth)acrylates); hydroxyl group containing (meth) acrylates (such as hydroxyethyl (meth)acrylate); epoxy group containing (meth)acrylates (such as glycidyl (meth) acrylates); isocyanate group containing monomers (such as methacryloyl isocyanate); and nitrile group containing monomers (such as (meth)acrylonitrile).

Suitable examples of other vinyl monomers include vinyl esters (such as vinyl acetate or vinyl propionate); diene monomers (such as butadiene or isoprene); halogenated olefins (such as vinyl chloride or vinyl bromide); α,β-ethylenically unsaturated mono or polycarboxylic acids (such as (meth)acrylic acids, crotonic acid, sorbinic acid, maleic acid, itaconic acid or cinnamic acid); anhydrides thereof (such as maleic anhydride) or half esters thereof (such as monomethyl maleate).

Among these, preferable styrenic polymers (B1) are styrene homopolymers, copolymers of styrene with (meth) acrylic monomers, copolymers of styrene with diene monomers, and copolymers of these monomers with a small amount of one or more additional copolymerizable monomers.

Styrenic polymer (B2) generally contains units resulting from styrene in an amount of not less than 40 mol %, and preferably not less than 60 mol %. According to the present invention, suitable examples of polyester (B2) include polycondensates of a polyol (7) with a polycarboxylic acid (8).

Suitable examples of polyols (7) include diols (7-1) and polyols containing 3 or more hydroxyl groups (7-2), preferably (7-1) and mixtures of (7-1) with a small amount of (7-2).

Suitable examples of diols (7-1) include alkylene glycols having 2-12 carbon atoms (such as ethylene glycol, 1,2-propylene glycol, 1,3-propylene glycol, 1,4-butane diol or 1,6-hexane diol); alkylene ether glycols (such as diethylene glycol, triethylene glycol, dipropylene glycol, polyethylene glycol, polypropylene glycol or polytetramethylene glycol); alicyclic diols (such as 1,4-cyclohexane dimethanol); hydrogenated bisphenols (such as bisphenol A, bisphenol F, a bisphenol S); alkylene oxide (such as ethylene oxide, propylene oxide or butylene oxide) and adducts of the above-mentioned bisphenols. Among these, preferred are alkylene glycols having 2–12 carbon atoms, alkylene oxide adducts of bisphenols and a combination thereof.

Suitable examples of polyols containing 3 or more hydroxyl groups (7-2) include aliphatic polyols having 3–20 carbon atoms (such as glycerol, trimethylolethane, trimethylolpropane, pentaerythritol, or sorbitol); phenols containing 3 or more hydroxyl groups (such as trisphenol PA, phenol novolac or cresol novolac); and oxyalkylene ethers of the above-mentioned phenols.

Suitable examples of polycarboxylic acids (8) include dicarboxylic acids (8-1) and polycarboxylic acids containing 3 or more carboxyl groups (8-2), preferably (8-1) or a mixture of (8-1) with a small amount of (8-2).

Suitable examples of dicarboxylic acids (8-1) include alkylene dicarboxylic acids having 2–20 carbon atoms (such as succinic acid, adipic acid or sebacic acid); alkenylene dicarboxylic acids (such as maleic acid or fumaric acid); and aromatic dicarboxylic acids having 8–20 carbon atoms (such as phthalic acid, isophthalic acid, terephthalic acid, or naphthalene dicarboxylic acid).

Among these, preferred are alkylene dicarboxylic acids having 2–20 carbon atoms and aromatic dicarboxylic acids having 8–20 carbon atoms.

Suitable examples of polycarboxylic acids containing 3 or more carboxyl groups (8-2) include aromatic polycarboxylic acids having 9–20 carbon atoms (such as trimellitic acid, or pyromellitic acid).

In producing polyester (B2), polyol (7) and dicarboxylic acid (8) are polycondensed in a molar ratio of (7):(8) of generally from 1:2 to 2:1, preferably from 1:1.5 to 1.5:1.

The molar ratio of (7-1):(7-2) in (7) is generally from 100:0 to 80:20, preferably from 100:0 to 90:10.

A suitable molar ratio of (8-1):(8-2) in (8) is the same as the molar ratio of (7-1):(7-2).

The amount by weight of (AB) based on the total weight of charge controller, in graft or block copolymers, is generally 1–100% by weight, preferably 10–100%. If the weight of (AB) is less than 1%, it becomes difficult to make the particle size of the discontinuous domains small. The amount by weight of (A) based on the total weight of charge controller is generally 0–99% by weight, preferably 0–90%, and the amount by weight of (B) is generally 0–90% by weight, preferably 0–50%. If the amount by weight of (B) is more than 99%, a lot of charge controller is required in order to get an adequate charge and is not economical.

In the charge controller of the invention, $W_a$ [the total weight content of (A) and (a)] is generally 10–99% by weight, preferably 20–90%. If $W_a$ is less than 10%, a lot of charge controller is required in order to get an adequate charge and is not economical. If $W_a$ is more than 99%, the effects due to graftwise or blockwise bonding are not apparent.

Suitable examples of the copolymer (AB), wherein (b) is connected by being bound graftwise or blockwise with (a) include the following:

(1) A graft copolymer wherein a superstrate polymer chain of (b) is grafted to a substrate polymer chain of (a);

(2) A graft copolymer wherein a superstrate polymer chain of (a) is grafted to a substrate polymer chain of (b);

(3) A block copolymer of (a) and (b).

Among these, preferred are the graft copolymer (1) and (2) mentioned above.

Moiety (a) has a weight-average molecular weight of generally 1,000–100,000, preferably 2,000–50,000.

Moiety (b) has a weight-average molecular weight of generally 1,000–500,000, preferably 3,000–100,000.

If the weight-average molecular weight of (a) or (b) is less than 1,000, the flowing properties of the toner are badly influenced, and if the weight-average molecular weight of (a) exceeds 100,000 or that of (b) exceeds 500,000, the charge controller can be difficult to disperse in the toner.

In order to make the particle size smaller, the total amount of polymer (A) is not necessarily copolymer (AB), and (AB) as a portion of (A) is sufficient. That is to say, polymer (A) can be contained in combination with copolymer (AB). Furthermore polymer (B) can be present without binding to moiety (a).

In order to obtain this effect, it is more preferable that the structure of (b) resemble that of the toner binder. Accordingly, (b1) is preferable as moiety (b) in cases where the toner binder is a styrenic polymer. Meanwhile (b2) is preferable as (b) in cases where the the toner binder is a polyester.

According to the present invention, the charge controller may be used together with a salt of a perfluoroalkyl group-containing organic acid (α). Simultaneous use of the salt (α) is desirable to improve the charging rate.

Suitable examples of salts of perfluoroalkyl group-containing organic acids (α) include perfluoroalkyl group-containing sulfonic acid salts (α-1), perfluoroalkyl group-containing carboxylic acid salts (α-2), perfluoroalkyl group-containing sulfamic acid salts (α-3), perfluoroalkyl group-containing acid sulfate salts (α-4) and perfluoroalkyl group containing acid phosphate salts (α-5).

Suitable salts (α-1) are salts of perfluoroalkyl group-containing sulfonic acids and cationic components. Suitable examples of perfluoroalkyl group-containing sulfonic acids include perfluoroalkanesulfonic acids (such as perfluorohexanesulfonic acid or perfluorooctanesulfonic acid); perfluoroalkylethanesulfonic acids (such as perfluorooctylethanesulfonic acid or perfluorodecylethanesulfonic acid) and perfluoroalkenyloxybenzensulfonic acids (such as perfluorononenyloxybenzensulfonic acid).

Suitable examples of cationic components include alkali metals (such as lithium, sodium, or potassium), alkaline earth metals (such as magnesium, calcium or barium), amines (such as triethylamine, tributylamine or N,N-dimethylbenzylamine), and quaternary ammoniums (such as tributylbenzylammonium, tetraethylammonium or tetrabutylammonium).

Suitable salts (α-2) are salts of perfluoroalkyl group-containing carboxylic acids and the cationic components mentioned above.

Suitable examples of perfluoroalkyl group-containing carboxylic acids include perfluoroalkanoic acids (such as perfluorahexanoic acid, or perfluorooctanoic acid) and perfluoroalkenyloxybenzoic acid (such as perfluorononenyloxybenzoic acid).

Suitable salts (α-3) are salts of perfluoroalkyl group-containing sulfamic acids and the above noted cationic components.

Suitable examples of perfluoroalkyl group-containing sulfamic acids include perfluoroalkylethanesulfamic acids (such as perfluorooctylethanesulfamic acid, or perfluorodecylethanesulfamic acid).

Suitable salts (α-4) are salts of perfluoroalkyl group-containing acid sulfates and the above cationic components.

Suitable examples of perfluoroalkyl group-containing acid sulfates include monoester sulfates of perfluoroalkyl group containing alcohols (such as perfluorooctylethanol, perfluorodecylethanol or perfluorohexylmethanol).

Suitable salts (α-5) are salts of perfluoroalkyl group-containing acid phosphates and the above-noted cationic components.

Suitable examples of perfluoroalkyl group-containing acid phosphates include monoester or diester phosphates of the above-noted perfluoroalkyl group-containing alcohol.

Among these salts (α), perfluoroalkyl group-containing sulfonic acid salts (α-1) are preferred, and alkali metal, alkaline earth metal or amine salts of a perfluoroalkyl group-containing sulfonic acid are more preferred. Salts of heavy metals (such as nickel, copper, zinc, mercury, or chromium) are undesirable because of safety. In the charge controller composition of the present invention, the weight ratio of the salt of a perfluoroalkyl group-containing organic acid (α) to polymer (A) or copolymer (AB) based on the total weight of charge controller composition, is generally in the range of 0–80% (α) to 20–100% (A) or (AB) by weight, preferably 1–80% (α) to 20–99% (A) or (AB) by weight, more preferably 3–50% (α) to 50–97% (A) or (AB) by weight. If the content of (α) is less than 1% by weight, the charging rate is inadequate. If it is more than 80% by weight, the saturated charge amount and environmental stability are insufficient.

Suitable examples of polymer (A) include (1) Dichlorophenylmaleimide homopolymer.

(2) A copolymer of 49% by weight of nitrophenylmaleimide, 48% by weight of a mixture of 1-alkenes of C12–C14 and 3% by weight of maleic anhydride.

(3) A copolymer of 51% by weight of dichlorophenylmaleimide, 45% by weight of a mixture of 1-alkenes of C12–C14 and 4% by weight of maleic anhydride.

(4) A copolymer of 55% by weight of nitrophenylmaleimide and 45% by weight of perfluoroalkyl (the mixture of C8–C12) ethyl methacrylate.

(5) A copolymer of 55% by weight of chlorophenylmaleimide and 45% by weight of perfluoroalkyl (the mixture of C8–C12) ethyl methacrylate.

(6) A copolymer of 48% by weight of dichlorophenylmaleimide and 52% by weight of perfluoroalkyl (the mixture of C8–C12) ethyl methacrylate.

(7) A copolymer of 49% by weight of dichlorophenylitaconimide and 51% by weight of perfluoroalkyl (the mixture of C8–C12) ethyl methacrylate.

(8) A copolymer of 34% by weight of dichlorophenylitaconimide, 42% by weight of monoperfluoroalkyl (the mixture of C8–C12) maleate and 14% by weight of methyl vinyl ether.

(9) A copolymer of 91% by weight of perfluoroalkyl (the mixture of C8–C12) ethyl methacrylate and 1% by weight of styrenesulfonic acid sodium salt.

(10) A copolymer of 89% by weight of perfluoroalkyl (the mixture of C8–C12) ethyl methacrylate and 11% by weight of styrenesulfonic acid barium salt.

(11) A copolymer of 85% by weight of perfluoroalkyl (the mixture of C8–C12) ethyl methacrylate and 15% by weight of styrenesulfonic acid tributylamine salt.

(12) A copolymer of 91% by weight of perfluoroalkyl (the mixture of C8–C12) ethyl acrylate and 1% by weight of styrenesulfonic acid sodium salt.

(13) A copolymer of 51% by weight of nitrophenylmaleimide, 41% by weight of perfluoroalkyl (the mixture of C8–C12) ethyl methacrylate and 8% by weight of 2-acrylamide-2-methylpropanesulfonic acid.

(14) A copolymer of 50% by weight of chlorophenylmaleimide, 45% by weight of perfluoroalkyl (the mixture of C8–C12) ethyl acrylate and 5% by weight of styrenesulfonic acid sodium salt.

(15) A copolymer of 96% by weight of dichlorophenylmaleimide and 4% by weight of styrenesulfonic acid sodium salt.

(16) A copolymer of 46% by weight of dichlorophenylmaleimide, 50% by weight of perfluoroalkyl (the mixture of C8–C12) ethyl methacrylate and 4% by weight of styrenesulfonic acid sodium salt.

(17) A copolymer of 45% by weight of dichlorophenylmaleimide, 50% by weight of perfluoroalkyl (the mixture of C8–C12) ethyl methacrylate and 5% by weight of styrenesulfonic acid tributylamine salt.

(18) A copolymer of 65% by weight of dichlorophenylitaconimide, 30% by weight of perfluoroalkyl (the mixture of C8–C12) ethyl acrylate and 5% by weight of styrenesulfonic acid magnesium salt (65/30/5).

(19) A copolymer of 56% by weight of dichlorophenylitaconimide, 40% by weight of perfluoroalkyl (the mixture of C8–C12) ethyl acrylate and 6% by weight of sulfophenylitaconimide sodium salt.

(20) A copolymer of 30% by weight of dichlorophenylitaconimide, 64% by weight of perfluoroalkyl (the mixture of C8–C12) ethyl methacrylate and 6% by weight of sulfophenylitaconimide sodium salt.

(21) A copolymer of 39% by weight of dichlorophenylmaleinimide, 42% by weight of perfluoroalkyl (the mixture of C8–C12) ethyl maleate, 5% by weight of sulfophonylitaconimide sodium salt and 14% by weight of methyl vinyl ether.

Suitable examples of copolymers (AB) of (a) with (b) include graft copolymers of the above-noted moiety (a) with the moiety (b) illustrated as follows:

(1) A moiety of styrene homopolymer.

(2) A moiety of styrene/butyl acrylate (95/5) copolymer.

(3) A moiety of styrene/butyl acrylate (87/13) copolymer.

A moiety of styrene/butyl methacrylate (75/25) copolymer.

(5) A moiety of styrene/butadiene (90/10) copolymer moiety.

(6) A moiety of bisphenol A propylene oxide 2 mol. adduct/isophthalic acid condensation polymer.

(7) A moiety of bisphenol A propylene oxide 2 mol. adduct/isophthalic acid condensation polymer.

(8) A moiety of bisphenol A propylene oxide 2 mol. adduct/terephthalic acid condensation polymer.

(9) A moiety of bisphenol A ethylene oxide 2 mol. adduct/maleic acid condensation polymer.

(10) A moiety of bisphenol A propylene oxide 3 mol. adduct/maleic acid condensation polymer.

(11) A moiety of bisphenol A ethylene oxide 3 mol. adduct/terephthalic acid condensation polymer.

An exemplary method for the preparation of polymer (A) in the present invention is as follows:

The polymer (A) is obtained by polymerizing the monomers required to be the aimed structure from the first stage of the reaction. For example, (A) is obtained by copolymerizing monomer (1), such as itaconic acid, with monomer (2) in the presence of azo-bis-isobutyronitrile, followed by reacting a group (X)-substituted aniline.

Exemplary preparation methods for the graft or block copolymers (AB) in the invention include:

1) A macromere method of obtaining a graft copolymer by copolymerizing a compound containing a structure introducing a group, such as an aryl group, at the end of the styrenic polymer moiety or polyester moiety (b), which is copolymerizable with the monomers composing (a) by which the copolymer moiety (a) can be introduced.

2) A polymer reaction method of obtaining a copolymer by copolymerizing a compound containing a structure introducing a group reactive with the copolymer moiety (a), such as an amino group or hydroxyl group, at the end of the styrenic polymer moiety or polyester moiety (b), with the reactable group in the side chain of the copolymer moiety (a), such as a carboxyl group or acid anhydride group.

3) Main chain initiating polymerization method of obtaining a graft copolymer by reacting a compound having a structure introducing a polymerization initiating group, such as a peroxide group, in the side chain of the styrenic polymer moiety (b1) or polyester moiety (b2), and the monomers composing (a) by which the copolymer moiety (a) can be introduced; or by reacting a compound containing a structure introducing a polymerization initiating group in the side chain of (a), with styrene and, if necessary, another copolymerizable monomer.

The preparation method of (a) is fundamentally the same as the above-mentioned production method of polymer (A). For example, the method of introducing a group reactive with the group located at the end of (b), such as a carboxyl group or acid anhydride group, is the same as the above-noted preparation method, and in order to introduce acid anhydride group, (a) is obtained by copolymerizing a monomer having an acid anhydride group in the same way as the method for preparing polymer (A) before the polymerization of the monomers composing (a).

Methods of introducing a polymerization initiating group in the side chain of (a) include, for example, reacting a hydroperoxide with (a) having an acid anhydride group.

The compound having a structure for introducing the above-mentioned reactive group at the end or side chain of the styrenic polymer moiety (b1) can be prepared by using conventional methods.

For example, a compound having a hydroxyl group at the end of (b1) is prepared by radical copolymerization of styrene and another copolymerizable monomer in the presence of a hydroxyl group-containing chain transfer agent.

A compound having a hydroxyl group at the end of the polyester moiety (b2) can be also prepared by using conventional methods.

For example, a compound having a hydroxyl group at the end of (b2) is prepared by using an excess amount of polyol (7) in the polycondensation of polyol (7) and polycarboxylic acid (8) which compose (b2). A compound having a methacryloyl group at the end of (b2) can be obtained by reacting methacryloyl isocyanate with the above-mentioned (b2) having a hydroxyl group.

Moreover, in preparing (b2), polyol (7) and polycarboxylic acid (8) are not necessarily used in the polycondensation. The claimed polyester moiety (b2) can also be prepared by using derivatives of (7) (such as lower monocarboxylic acid esters, or alcoholates) and derivatives of (8) (such as lower alcohol esters, acid anhydrides, or acid halides) for polycondensation.

The charge controller of the present invention can be preliminarily mixed with a toner binder, before preparing the toner, to provide a toner binder composition of the present invention having charge controlling properties.

Suitable toner binders include styrenic polymers, polyesters, epoxy resins, polyolefins, polyurethanes and other conventional polymers normally used as toner binders.

Suitable styrenic polymers include: copolymers of styrene with (meth)acrylates, copolymers of styrene with diene monomers (such as butadiene and isoprene), and copolymers of styrene with other copolymerizable monomers.

Suitable polyesters include polycondensates of aromatic dicarboxylic acids with oxyalkylene ethers of bisphenols.

Suitable epoxy resins include reaction products of aromatic diols and epichlorohydrines and modified compounds thereof.

Suitable polyolefins include polyethylene, polypropylene, and copolymers of ethylene and/or propylene with one or more copolymerizable monomers.

Suitable polyurethanes include a polyaddition compound of an aromatic diisocyanate and an alkylene oxide adduct of an aromatic diol.

Illustrative methods of preparing the toner binder composition of the present invention include the following:

(1) a method of polymerizing the monomers for preparing the toner binder mentioned above in the presence of the charge controller.

(2) a method of mixing the toner binder and the charge controller in a suitable solvent. Suitable solvents include aromatic hydrocarbons (such as toluene or xylene), halogenated compounds (such as chloroform or ethylene dichloride), ketones (such as acetone or methylethyl ketone) or amides (such as dimethylformamide).

(3) A method of thermally melting and mixing the toner binder and the charge controller. The charge controller of the present is mixed with a toner binder and a colorant, and used as a toner composition of the present invention.

Suitable colorants include conventional pigments and dyestuffs, such as carbon black, iron black, Sudan black SM, First yellow G, Benzidine yellow, Pigment yellow, India first orange, Irgasine red, Baranito aniline red, Toluidine red, Carmine FB, Pigment orange R, Raykired 2G, Rodamine FB, Rodamine B rake, Methylviolette B rake, Phthalocyanine blue, Pigment blue, Brilliant green, Phthalocyanine green, Oil yellow GG, Kayaset YG, Orasol brown B, Oil pink OP.

The toner binder composition and the electrophotographic toner of the present invention contain polymer in an amount of generally 0.1–20% by weight, preferably 0.3–10% by weight based on toner.

If the amount of polymer is less than 0.1%, the charge in the toner becomes small, and if it is more than 20%, the environmental stability of the toner deteriorates.

The toner of the present invention comprises, based on the weight of toner, generally 0.1–20% by weight of charge controller, 30–95% by weight of toner binder, 0–15% by weight of colorant, and if necessary, less than 60% by weight of a magnetic powder. Suitable magnetic powders include powders of strong magnetic metal (such as iron, cobalt, or nickel), magnetite, hematite, and ferrite. These magnetic powders have properties as a colorant.

In addition, various conventional additives can be used, including, but not limited to, for example, lubricants (such as polytetrafluoroethylene, low molecular weight polyolefins, fatty acids or metal salts or amides thereof) and other conventional charge controllers (such as azo dyestuffs containing metal, or salicylic acid metal salts). Furthermore, fine particles of hydrophobic colloidal silica can be used in order to improve the flow properties of the toner. The amount of these additives is generally less than 10% by weight based on the weight of the toner.

Preferable binder compositions include ones comprising:

(1) discontinuous domains composed at least in part of the charge controller; and (2) a continuous phase composed at least in part of a toner binder.

The charge controller is easily exposed on the surface and the toner is capable of providing sufficient charge even with addition of only a small amount of the charge controller, as compared with a charge controller compatible with the toner binder.

Phases or domains of (1) and (2) noted above can be determined by checking the existence of an interface through observation of the toner with a transmission electromicroscope. For a clear examination of the interface, it is effective to examine a cut of the toner with an electromicroscope after dyeing the cut with a dye such as ruthenium tetraoxide, or osmium tetraoxide.

These domains have a particle size of generally 0.01–4 μm, preferably 0.05–2 μm. Particles of more than 4 μm cause insufficient dispersibility, a wider charge distribution, and worse transparency in usage of color toner, while those of less than 0.01 μm do not form discontinuous domains and show compatibility with the binder. Therefore the content of the charge controller on the surface of the toner becomes smaller and the charge becomes insufficient.

The preparation method of the electrophotographic toner of the present invention is not particularly limited. Illustrative methods of the same include:

(1) Kneading and pulverizing method

The components of the toner are blended in a dry atmosphere and then kneaded, followed by roughly crushing and finally pulverizing, such as with a jet mill. The product is then classified into a fine powder having an average particle size of 5–20 μm, to obtain the toner.

(2) Additional blending method

In a dry atmosphere, the charge controller of the invention is blended with particles having a diameter of from 5 to 20 μm, comprising the toner binder and the colorant, with or without the lubricant and the magnetic powder, followed by mixing the blended product vigorously with a mixer, optionally under heating, to obtain the toner.

(3) Polymerization method

The charge controller of the present invention, the colorant and the other components are dispersed and dissolved in raw material monomers of the toner binder, followed by polymerizing them in water. The product is dried and the toner having a diameter of from 5 to 20 μm is obtained.

The toner of the present invention is, if necessary, mixed with a carrier powder, such as iron powder, nickel powder or glass beads, and may be used as a developer for an electrostatic latent image in electrophotography.

The toner of the present invention may be fixed on a substrate, such as paper, or polyester film, with a copying machine or a printer. Illustrative fixing methods on the substrate include a heat roll fixing method and a flash fixing method.

The charge controller of the present invention may also be useful for a liquid developer and powder coat.

Having generally described the invention, a more complete understanding can be obtained by reference to certain specific examples, which are included for purposes of illustration only and are not intended to be limiting unless otherwise specified.

EXAMPLES

Hereinafter, part(s) means part(s) by weight.

(1) Measurement of the Dielectric Loss Tangent [tan δ]

A charge controller is pulverized with an agate mortar into a powder having an average diameter of no more than 50 μm, and a test piece is prepared by compression molding in an electrode. The equipment used for this measurement:

body; TR-1100 (supplied from Ando Denki Co., Ltd.)

electrode; SE-43 (supplied from Ando Denki Co., Ltd.)

frequency; 100 kHz (2) Measurement of the Water Absorbency

In the same manner as above, after the charge controller is pulverized with an agate mortar into a powder having an average diameter of no more than 50 μm, 2 g of the powder is weighed and dried under reduced pressure at 35° C. for 4 hours, followed by control of the moisture of 85% R.H. at 35° C. for 12 hours. Thereafter the weight is measured again and the water absorbency (%) is calculated from the percentage increase in weight (the difference between the weight after drying and that before drying) per the weight before drying.

(3) Preparation of Developers

The developers were prepared by mixing 1 part of the toner and 24 parts of the ferrite carrier coated with silicone resin for electrophotography (FL961-150, supplied from Powdertec, Ltd.).

(4) Measurement of the Electrostatic Charge (Saturated Charge)

The moisture levels of the above-noted developers were controlled at 23° C. under 50% R.H. for at least 8 hours, and then each sample was stirred with a terbler shaker mixer using a frictional force at 50 r.p.m. for periods of 1, 3, 7, 20, 60 and 120 minutes, and the electrostatic charge was measured in each period. The charge at the period when the electrostatic charge showed no growth was defined as the saturated charge.

The equipment used for this measurement: Blow off method charge measuring machine (supplied from Toshiba Chemical Co., Ltd.).

(5) Evaluation Criteria of the Charging Rate

In accordance with the above-noted results of the amount of charge measured, the ranking of the charging rate was determined based on the following criteria:

A: The stirring period using a frictional force was less than 7 minutes, when the charge reaches up to 80% of the saturated charge.

B: The stirring period using a frictional force was 7–20 minutes

C: The stirring period using a frictional force was 20–60 minutes

D: The stirring period using a frictional force was more than 60 minutes (6) Measurement of Dependence on the Circumstances After the moisture of the above-noted developers was controlled in high temperature and high humidity and in low temperature and low humidity, the electrostatic charge of these samples was measured.

Low temperature and low humidity: 10° C., 40% R.H.

High temperature and high humidity: 35° C., 85% R.H.

Evaluation Criteria:

The change in the amount of electrostatic charge at low temperature and low humidity and at high temperature and high humidity was—A: small, B: medium, C: large.

(7) Measurement of Charge Distribution

The moisture levels of the above-noted developers were controlled at 23° C. under 50% R.H. for not less than 8 hours, and the test samples were mixed with a terbler shaker mixer using a frictional force at 50 r.p.m. for 20 min., and then the charge distribution was measured.

Equipment: The charge distribution of the particle testing machine (EST-1, supplied from Hosokawa Micron, Co., Ltd.)

Evaluation Criteria:

A: The charge distribution was narrow.

B: The charge distribution was medium.

C: The charge distribution was wide.

(8) Copying Test

A continuous copying test of the above-noted developers was done with a copying machine for evaluation.

Copying machine for evaluation:

A negatively charged electrophotographic copying machine using selenium sensitized material was used. The number of papers available for continuous copying was 20,000.

Evaluation Criteria:

A: The copied image on the paper was good after 20,000 sheets of continuous copying.

B: Deterioration of the copied image on the paper was slightly observed after 20,000 sheets of continuous copying.

C: Deterioration of the copied image on the paper was signficantly observed after 20,000 sheets of continuous copying.

D: The copied image was poor from the beginning of copying.

(9) Evaluation of Transparency

The toner binders and the charge controllers were kneaded without the addition of colorants and low molecular weight polypropylene, and then the kneaded samples were molded into cylindrical pellets of about 5 mm with a melt indexer and the transparency of the pellets was visually evaluated.

Evaluation Criteria

A: Transparent

B: Slightly cloudy

C: Cloudy in white color

Example A1

In xylene at the boiling point, 733 parts of a copolymer of a mixture of 1-alkenes of C12–14 with maleic anhydride (PA-124, supplied from Mitsubishi Chemical Industries, Ltd.) and 307 parts of m-nitroaniline were reacted for 4 hours with removal of water to form an imide. Xylene was then distilled off, to obtain the charge controller (A1) of the present invention.

Example A2

Example A1 was repeated, except using 360 parts of 3,4-dichloraniline in place of m-nitroaniline, to obtain the charge controller (A2) of the present invention.

Example A3

In xylene at the boiling point, 647 parts of a copolymer of a mixture of 1-alkenes of C12–14 with maleic anhydride (PA-124), and 130 parts of perfluroalkylethanol (Cheminox FA-M[C10up], supplied from Japan Mectron Co., Ltd.) were half-esterified for 5 hours.

Thereafter 256 parts of m-nitroaniline was added to be reacted for 5 hours with removal of water to form an imide. Xylene was then distilled off to obtain the charge controller (A3) of the present invention.

Example A4

Into an autoclave were charged 800 parts of a copolymer of a mixture of 1-alkenes of C12–14 with maleic anhydride (PA-124, supplied from Mitsubishi Chemical Industries, Ltd.), and 200 parts of styrene in the presence of 0.4 part of di-tert-butyl peroxide as an initiator, polymerized graftwise at 80° C., to obtain a graftwise-polymer (1).

Example A3 was repeated, except using 809 parts of the above-mentioned graftwise-polymer (1) in place of the copolymer of a mixture of 1-alkenes of C12–14 with maleic anhydride (PA-124), to obtain the charge controller (A4) of the present invention.

Example A5

723 parts of bisphenol A propylene oxide 2 mol. adduct and 348 parts of terephthalic acid were polycondensed at 230° C. using 2 parts of dibutyltin oxide as a catalyst, to obtain a polyester (1) having a weight-average molecular weight of 6,000 and a hydroxyl value of 20 mg KOH/g.

In xylene at the boiling point, 647 parts of a copolymer of a mixture of 1-alkenes of C12–14 with maleic anhydride (PA-124), 162 parts of the polyester (1), and 130 parts of perfluoroalkylethanol (Cheminox FA-M[C10up]), were half-esterified for 5 hours.

Thereafter 256 parts of m-nitroaniline were added to be reacted for 5 hours with removal of water to form to an imide. Xylene was then distilled off to obtain the charge controller (A5) of the present invention.

Example A6

In N,N-dimethylformamide (DMF) at the boiling point, 508 parts of m-nitrophenylmaleimide, 412 parts of perfluoroalkylethyl methacrylate (Cheminox FAMAC-C8, supplied from Japan Mectron Co.,Ltd.) and 80 parts of 2-acrylamide-2-methylpropanesulfonic acid were polymerized for 8 hours using di-tert-butylperoxide as an initiator, followed by distilling off DMF to obtain the charge controller (A6) of the present invention.

Example A7

Example A6 was repeated, except using 457 parts of 3,4-dichlorophonylmaleimide, 503 parts of perfluoroalkylethyl methacrylate and 40 parts of styrenesulfonic acid sodium salt, in place of m-nitrophenylmaleimide, 412 parts of perfluoroalkylethyl methacrylate and 2-acrylamide-2-methylpropanesulfonic acid to obtain the charge controller (A7) of the present invention.

Example A8

500 parts of styrene and DMF were further added to 500 parts of the charge controller (A7), and polymerized graftwise for 4 hours using di-tert-butyl peroxide as an initiator, followed by distilling off DMF to obtain the charge controller (AS) of the invention.

Example A9

Example A6 was repeated, except using 960 parts of 3,4-dichlorophenylmaleimide, 40 parts of styrenesulfonic acid sodium salt, in place of m-nitrophenylmaleimide, perfluoroalkylethyl methacrylate and 2-acrylamide-2-methylpropane-sulfonic acid to obtain the charge controller (A9) of the present invention.

Example A10

In methyl ethyl ketone (MEK), 511 parts of perfluoroalkylethyl acrylate (FLUOWET AC-812, supplied from Hechst Industries Co., Ltd.) and 223 parts of itaconic anhydride were polymerized for 4 hours using 50 parts of azo-bis-isobutyronitrile as an initiator, to obtain a copolymer (1) having a weight-average molecular weight of 18,000.

Into an autoclave were charged 800 parts of the copolymer (1) and 1,000 parts of styrene in the presence of di-tert-butyl peroxide as an initiator and polymerized graftwise at 180° C. for 4 hours, followed by distilling off MEK under reduced pressure to obtain a graftwise-polymer (2).

262 parts of 3,4-dichloroaniline, 37 parts of p-aminobenzenesulfonic acid sodium salt and DMF were added to 1734 parts of the graft-copolymer (2), and reacted for 8 hours in DMF at the boiling point to form an imide, followed by distilling off DMF to obtain the charge controller (A10) of the present invention.

Example A11

In DMF, 912 parts of perfluoroalkylethyl methacrylate (Cheminox FAMAC-C8) and 88 parts of styrenesulfonic acid sodium salt were polymerized for 4 hours in DMF at the boiling point, using azo-bis-isobutyronitrile as an initiator, followed by distilling off DMF to obtain the charge controller (A11) of the present invention.

Example A12

Example A6 was repeated, except using 476 parts of 3,4-dichlorophenylmaleimide and 524 parts of perfluoroalkylethyl methacrylate, in place of m-nitrophenylmaleimide and 412 parts of perfluoroalkylethyl methacrylate and 2-acrylamide-2-methylpropanesulfonic acid, to obtain a copolymer (1).

200 parts of perfluorooctanesulfonic acid sodium salt was added to the copolymer (1), and dissolved uniformly, followed by distilling off DMF to obtain the charge controller (A12) of the present invention.

Example A13

Example A6 was repeated, except using 1,000 parts of 1,3-dichlorophenylmaleimide alone, in place of m-nitrophenyl maleimide, perfluoroalkylethyl methacrylate and 2-acrylamide-2-methylpropanesulfonic acid to obtain homopolymer (1).

200 parts of the barium salt of perfluorooctanesulfonic acid was added to the homopolymer (1), and dissolved uniformly, followed by distilling off DMF to obtain the charge controller (A13) of the present invention.

COMPARATIVE EXAMPLES CA1

Example 1 was repeated, except using 243 parts of m-aminophenol in place of m-nitroaniline to obtain the charge controller (CA1) for comparison.

COMPARATIVE EXAMPLES CA2

In a mixture of toluene and methanol, 920 parts of styrene and 80 parts of 2-acrylamide-2-methylpropanesulfonic acid were polymerized for 8 hours using azo-bis-isobutyronitrile as an initiator, followed by distilling off solvent under reduced pressure to obtain the charge controller (CA2) for comparison.

COMPARATIVE EXAMPLES CA3

In DMF at the boiling point, 912 parts of styrene and 88 parts of styrenesulfonic acid sodium salt, were polymerized for 4 hours using azo-bis-isobutyronitrile as an initiator, followed by distilling off DMF under reduced pressure to obtain the charge controller (CA3) for comparison.

COMPARATIVE EXAMPLES CA4

In toluene at the boiling point, 1,000 parts of perfluoroalkylethyl methacrylate was polymerized for 4 hours using azo-bis-isobutyronitrile as an initiator, followed by distilling off toluene under reduced pressure to obtain the charge controller (CA4) for comparison.

COMPARATIVE EXAMPLE CA5

Example A11 was repeated, except using 721 parts of perfluoroalkylethyl methacrylate and 278 parts of styrenesulfonic acid sodium salt, in place of 912 parts of perfluoroalkylethyl methacrylate and 88 parts of styrenesulfonic acid sodium salt to obtain the charge controller (CA5) for comparison.

COMPARATIVE EXAMPLES CA6

Perfluorooctanesulfonic acid sodium salt was used as the charge controller (CA6) for comparison.

TABLE 1

| Charge Controller No. | Dielectric Loss tangent [tan δ] | Water Absorbency (%) |
|---|---|---|
| (A1) | 0.012 | 0.7 |
| (A2) | 0.010 | 0.6 |
| (A3) | 0.014 | 0.6 |
| (A4) | 0.009 | 0.5 |
| (A5) | 0.013 | 0.8 |
| (A6) | 0.015 | 1.7 |
| (A7) | 0.039 | 1.5 |
| (A8) | 0.017 | 0.9 |
| (A9) | 0.016 | 1.6 |
| (A10) | 0.015 | 0.9 |
| (A11) | 0.050 | 1.6 |
| (A12) | 0.088 | 1.3 |
| (A13) | 0.084 | 0.9 |
| (CA1) | 0.007 | 3.1 |
| (CA2) | 0.006 | 4.3 |
| (CA3) | 0.006 | 5.7 |
| (CA4) | 0.007 | 0.1 |
| (CA5) | 0.420 | 8.4 |
| (CA6) | | — |

Example B1

40 parts of the charge controller (A4) and 1000 parts of a styrenic toner binder (Himer UNI-3000, supplied from Sanyo Chemical Industries, Ltd.) were dissolved and mixed in toluene.

On removing toluene, the toner binder composition (B1) of the present invention was obtained.

Example B2

20 parts of the charge controller (A8) and 1000 parts of a styrenic toner binder (Himer UNI-3000) were dissolved and mixed in DMF. On removing DMF, the toner binder composition (B2) of the present invention was obtained.

After dyeing a cut of toner binder composition (B2) with ruthenium tetraoxide, about 1 μm of dispersed particles were observed with a transmission electron-microscope (TEM). However, in accordance with Himer UNI-3000, no dispersed particles were observed.

Example B3

Condensation polymerization of 417 parts of bisphenol A propylene oxide 2 mol. adduct, 341 parts of bisphenol A ethylene oxide 2 mol. adduct and 310 parts of terephthalic acid was carried out using 2 parts of dibutyltinoxide as a catalyst, to obtain the polyester toner binder (1) having a weight-average molecular weight of 8,000.

10 parts of the charge controller (A7) and 1,000 parts of the toner binder (1) were mixed in the same manner as Example B2, to obtain the toner binder composition (B3) of the invention.

About 2 μm of dispersed particles were observed by TEM.

Examples T1–T4

COMPARATIVE EXAMPLES CT1

Each toner was prepared using, as components, each charge controller (parts) as shown in Table 2, 1000 parts of styrenic toner binder (Himer UNI-3000, supplied from Sanyo Chemical Industries, Ltd.), 50 parts of carbon black (MA-100, supplied from Mitsubishi Chemical Industries, Ltd.) and 40 parts of low molecular weight polypropylene (Viscol 660P, supplied from Sanyo Chemical Industries, Ltd.) according to the following process:

The components were preliminarily mixed with a Henschel mixer (FM1OB, supplied from Mitsuimiike Kakouki, Ltd.) and then kneaded with a twin screw extruder (PCM-30, supplied from Ikegai, Ltd.). Each of the resulting products was further finely pulverized with a supersonic jet mill Labo Jet (supplied from Japan Pneumatic Industries, Ltd.) and classified afterwards with an air stream classifier (MDS-1, supplied from Japan Pneumatic Industries, Ltd.) to obtain each powdered product having a particle size of 5–20 μm, (toners (T1)–(T4) of the present invention and toner (CT1) for comparison).

The evaluation results are shown in Table 2.

Example T5

Example T1 was repeated, except using 1040 parts of the toner binder composition (B1) in place of Himer (UNI-3000) and except without adding any charge controller, to obtain the toner (T5) of the present invention.

The evaluation results are shown in Table 2.

Examples T6–T13

COMPARATIVE EXAMPLES CT2–CT8

Example T1 was repeated, except using 80 parts of carbon black in place of 50 parts, to obtain the toners (T6)–(T13) of the present invention and the toners (CT2)–(CTS) for comparison.

The evaluation results are shown in Table 2.

Example T14

Example T6 was repeated, except using 1020 parts of the toner binder composition (B2) in place of Himer UNI-3000 and except without adding any charge controller, to obtain the toner (T14) of the present invention.

The evaluation results are shown in Table 2.

TABLE 2

| Toner No. | Charge No. | Controller Amount (part) | *1 | *2 | *3 | *4 | *5 |
|---|---|---|---|---|---|---|---|
| (T1) | (A1) | 25 | −24 | B | A | A | B |
| (T2) | (A2) | 25 | −26 | B | A | A | B |
| (T3) | (A3) | 25 | −26 | B | A | A | A |
| (T4) | (A4) | 30 | −24 | B | A | A | A |
| (T5) | (B1) | 1040 | −23 | B | A | A | A |
| (T6) | (A6) | 10 | −24 | B | B | B | A |
| (T7) | (A7) | 10 | −21 | A | A | B | A |
| (T8) | (A8) | 20 | −22 | A | A | A | A |
| (T9) | (A9) | 10 | −18 | B | A | B | A |
| (T10) | (A10) | 20 | −22 | A | A | A | A |
| (T11) | (A11) | 10 | −17 | A | B | B | A |
| (T12) | (A12) | 10 | −19 | A | A | B | A |
| (T13) | (A13) | 10 | −19 | A | A | B | B |
| (T14) | (B2) | 1020 | −21 | A | A | A | A |
| (CT1) | (CA1) | 30 | −15 | C | B | A | D |
| (CT2) | (CA2) | 50 | −18 | C | C | A | C |
| (CT3) | (CA3) | 10 | −11 | C | C | B | D |
| (CT4) | (CA3 | 10 | −10 | C | B | B | D |
| (CT5) | (CA5) | 10 | −12 | A | C | C | D |
| (CT6) | (CA6) | 10 | −11 | A | C | B | D |
| (CT7) | (CA4)/ (CA2) | 10/50 | −17 | C | C | B | C |
| (CT8) | None | | −9 | D | C | B | D |

*1: Saturated charge (μ C/g)
*2: Charging rate
*3: Dependence to circumstances
*4: Charge distribution
*5: Copying test Examples T15–T19

Condensation polymerization was performed using 751 parts of bisphenol A propylene oxide 2 mol. adduct and 104 parts of trimellitic anhydride and 2 parts of dibutyltin oxide as a catalyst, to obtain the polyester toner binder (2) having a softening point of 127° C.

Example T1 was repeated, except using polyester toner binder (2) in place of the styrenic toner binder, in accordance with the recipes as shown in Table 3, to obtain the toners (T15) and (T16) of the present invention.

Example T6 was repeated as well, except using polyester toner binder (2) in place of the styrenic toner binder, in accordance with the recipes as shown in Table 3, to obtain the toners (T17)–(T19) of the present invention.

The evaluation results are in Table 3.

TABLE 3

| Toner No. | Charge No. | Controller Amount (part) | *1 | *2 | *3 | *4 | *5 |
|---|---|---|---|---|---|---|---|
| (T15) | (A3) | 25 | −27 | B | A | B | B |
| (T16) | (A5) | 30 | −24 | B | A | A | B |
| (T17) | (A7) | 10 | −20 | A | A | B | A |
| (T18) | (A10) | 20 | −21 | A | A | A | A |
| (T19) | (A12) | 10 | −18 | A | A | B | A |

*1: Saturated charge (μ C/g)
*2: Charging rate
*3: Dependence to circumstances
*4: Charge distribution
*5: Copying test Example T20

Example T1 was repeated, except using 1,000 parts of polyester toner binder (1), 40 parts of the colorant (Firstgenmazenta R-11, supplied from Dainippon Ink Industries, Ltd.) and charge controller in accordance with the recipes as shown in Table 3, in place of the styrenic toner binder, to obtain the toner (T20) of the present invention.

The evaluation results are in Table 4.

Example T21

Example T20 was repeated, except using toner binder composition (B3) in place of toner binder (1) and except without adding any charge controller, to obtain the toner (T21) of the present invention.

The evaluation results are in Table 4.

TABLE 4

| Toner No. | Charge No. | Controller Amount (part) | *1 | *2 | *3 | *4 | *6 |
|---|---|---|---|---|---|---|---|
| (T20) | (A10) | 20 | −22 | A | A | A | B |
| (T21) | (B3) | 1020 | −20 | A | A | A | A |

*1: Saturated charge (μ C/g)
*2: Charging rate
*3: Dependence to circumstances
*4: Charge distribution
*6: Transparency

What is claimed as new and desired to be secured by letters patent of the United States is:

1. A charge controller for a toner, comprising a polymer of an ethylenically unsaturated monomer, said polymer having a dielectric loss tangent (tan δ) at 100kHz of 0.008 to 0.3 and a water absorbency of at most 10% by weight, and selected from the group consisting of:

(1) a polymer (A1) having units resulting from a monomer (1) having an aromatic ring substituted with at least one electron-attracting group (X) selected from the group consisting of halogen, a nitro group and a cyano group; and (2) a copolymer (A2) of a monomer (2) having an organic acid group or salt thereof, with one or more copolymerizable monomers.

2. The charge controller of claim 1, wherein said polymer (A1) comprises at least 5% by weight of units resulting from said monomer (1).

3. The charge controller of claim 2, wherein said monomer (1) is an ethylenically unsaturated monomer selected from the group consisting of styrenes, aromatic ring-containing maleimides, aromatic ring-containing itaconimides, aromatic ring-containing (meth)acrylates, aromatic ring-containing (meth)acrylamides and aromatic ring-containing vinyl ethers, the aromatic ring of said monomer being substituted with an electron-attracting group (X).

4. The charge controller of claim 2, wherein said monomer (1) is a phenylmaleimide or a phenylitaconimide, the aromatic ring of which is substituted with an electron-attracting group (X).

5. The charge controller of claim 2, wherein said polymer (A1) further comprises from 0.1–20% by weight of units resulting from a monomer (2) containing an organic acid group or salt thereof.

6. The charge controller of claim 2, wherein said polymer (A1) further comprises units resulting from a monomer (3) selected from the group consisting of perfluoroalkyl group-containing monomers and silicone group-containing monomers.

7. The charge controller of claim 5, wherein said polymer (A1) further comprises units resulting from a monomer (3)

selected from the group consisting of perfluoroalkyl group-containing monomers and silicone group-containing monomers.

8. The charge controller of claim 7, wherein the units resulting from said monomer (3) are contained in an amount of 10–94.9% by weight.

9. The charge controller of claim 1, wherein said copolymer (A2) comprises 0.1–20% by weight of units resulting from said monomer (2), with 80–99.9% by weight of units resulting from said one or more copolymerizable monomers.

10. The charge controller of claim 9, wherein said organic acid is selected from the group consisting of sulfonic acids, sulfamic acids, acid sulfates, carboxylic acids and acid phosphates.

11. The charge controller of claim 9, wherein said organic acid is a sulfonic acid.

12. The charge controller of claim 9, wherein said monomer (2) is a salt of an aromatic sulfonic acid group-containing monomer.

13. The charge controller of claim 9, wherein said sulfonic acid is an member selected from the group consisting of styrenesulfonic acids, sulfophenylacrylamides, sulfophenylmaleimides and sulfophenylitaconimides.

14. The charge controller of claim 9, wherein said salt is a salt of at least one member selected from the group consisting of alkali metals, alkaline earth metals, amines and ammoniums.

15. The charge controller of claim 9, wherein said one or more copolymerizable monomers is a member selected from the class consisting of perfluoroalkyl group-containing monomers and silicone group-containing monomers.

16. The charge controller of claim 1, wherein said polymer comprises a copolymer (AB) comprising: a polymer moiety (a) of a polymer (A) selected from the group consisting of said polymer (A1) and said copolymer (A2), and a polymer moiety (b) of a polymer (B) selected from the group consisting of styrenic polymers (B1) and polyesters (B2), said moiety (b) being bound graftwise or blockwise to said moiety (a).

17. The charge controller of claim 1, wherein said polymer has a weight-average molecular weight of from 1,000 to 500,000.

18. The charge controller of claim 16, wherein said moiety (a) has a weight-average molecular weight of from 1,000 to 100,000 and moiety (b) has a weight-average molecular weight of from 1,000 to 500,000.

19. A charge controller composition comprising the charge controller according to claim 1, and a salt of a perfluoroalkyl group-containing organic acid ($\alpha$).

20. A toner binder composition comprising the charge controller according to claim 1, and a toner binder resin.

21. A toner comprising, a toner binder resin, a colorant and said charge controller according to claim 1.

22. The toner of claim 21, wherein at least a portion of said toner binder constitutes a continuous phase, and at least a portion of said charge controller constitutes one or more discontinuous domains.

* * * * *